United States Patent [19]

Savarino

[11] 3,991,420

[45] Nov. 16, 1976

[54] PROTECTIVE BASEBALL BATTING GARMENT

[76] Inventor: Julius P. Savarino, 2805 Pearl St., Groves, Tex. 77619

[22] Filed: Aug. 11, 1975

[21] Appl. No.: 603,765

[52] U.S. Cl. ..... 2/2; 2/16; 2/268; 36/71

[51] Int. Cl.[2] ..... A41D 13/08; A41D 27/26; A43B 19/00

[58] Field of Search ..... 2/2, 16, 22, 24, 62, 2/267, 268; 36/71

[56] References Cited

UNITED STATES PATENTS

| | | | |
|---|---|---|---|
| 575,673 | 1/1897 | Winters | 2/2 |
| 1,525,298 | 2/1925 | Hartman | 2/24 |
| 2,589,636 | 3/1952 | Smith | 2/16 |
| 2,990,549 | 7/1961 | Doughty | 2/2 |
| 3,691,564 | 9/1972 | LaMarre et al. | 2/2 |
| 3,801,984 | 4/1974 | Kanicki | 2/2 |

*Primary Examiner*—Patrick D. Lawson
*Attorney, Agent, or Firm*—William E. Kinnear

[57] ABSTRACT

The protective baseball batting garment is an article used by batters only while at bat in the playing of the game of baseball as done in the United States and perhaps some foreign countries. The protective jacket is adapted to protect the upper portion of the human torso and arms where severe injury to the batter is most prevalent caused by a baseball thrown by the pitcher of the opposing team in the field to a batter at home plate in the batters box during the playing of the game of baseball. Hard pads or padded sections are sewn into or on the exterior of a jacket to protect the forearm, elbow and outer bicep of arm facing the opposing pitcher, opposed side padded sections, shoulder and shoulder blades and back section, all of which are provided with inner more resilient materials to absorb the shock of the thrown baseball by opposing pitcher to a batter in the batters box who is wearing the jacket so padded. The side sections protect the rib areas, the shoulder and shoulder blade section protect the shoulder and shoulder blades and the back section protect the spine and back, and, these particular sections are arranged so that flexible areas bounded each section is provided by sewing through the material of the jacket between the various sections to give flexibility to the jacket so that the batter has freedom of movement in the areas specified between the various padded sections so that the batter can freely swing his bat to hit the baseball thrown to him by the opposing pitcher.

5 Claims, 8 Drawing Figures

PROTECTIVE BASEBALL BATTING GARMENT

The invention relates to improvements in jacket or sweat shirt adapted to protect vulnerable upper portion of torso and arms of a baseball batter at bat who may be hit and injured by a thrown baseball by pitcher on opposing team.

An object of the invention is to provide a jacket or sweater of the character described having divided padded sections in a cluster with flexible material of said jacket or sweater surrounding said section to protect the elbow of the arm of a batter facing the pitcher.

Another object of the invention is provide a jacket or sweater of the character described having padded rib sections on opposite sides of the jacket or sweater and flexibly attached to the rear of the front section of the jacket or sweater and flexibly attached to the back padded section at the back of same, as well as, being flexibly attached to the respective padded shoulder blade sections of same by intervening flexible materials of said jacket or sweater.

A further object of the invention is to provide a jacket or sweater of the character described having divisional sections to protect the shoulder and shoulder blades of a batter and flexibly connected to the back padded section of same and oppositely disposed padded rib sections.

A still further object of the invention is to provide a jacket or sweater of the character described having a back padded section flexibly attached between the shoulder blade padded sections and extending down to the lower back portion of said jacket or sweater and flexibly attached to the oppositely disposed padded rib sections.

These and other object of the invention will in part be obvious and will in part be more fully described in the specification, two embodiments of which are illustrated in the drawings, in which.

Figure 1:
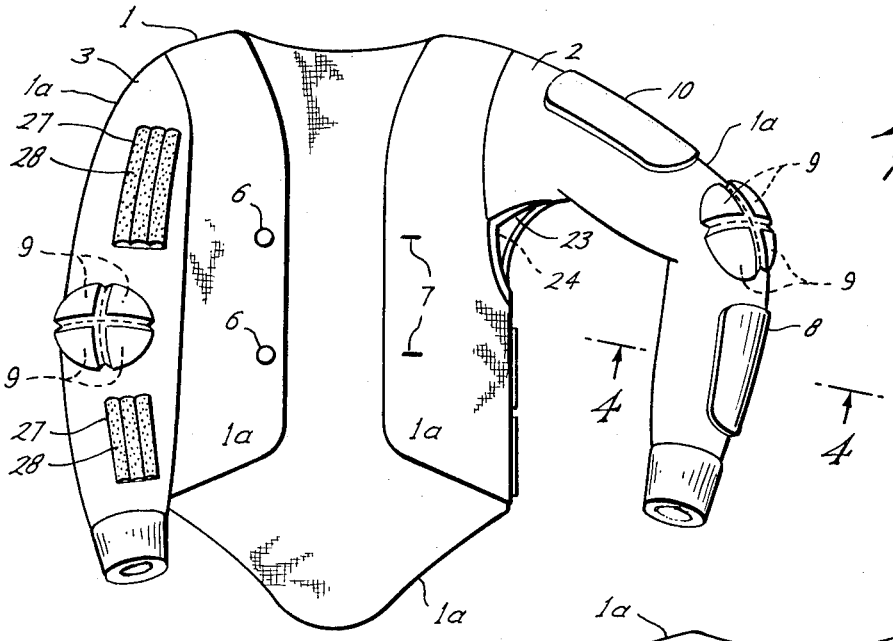
FIG. 1 is a front vertical view in elevation of the jacket.
Figure 2:
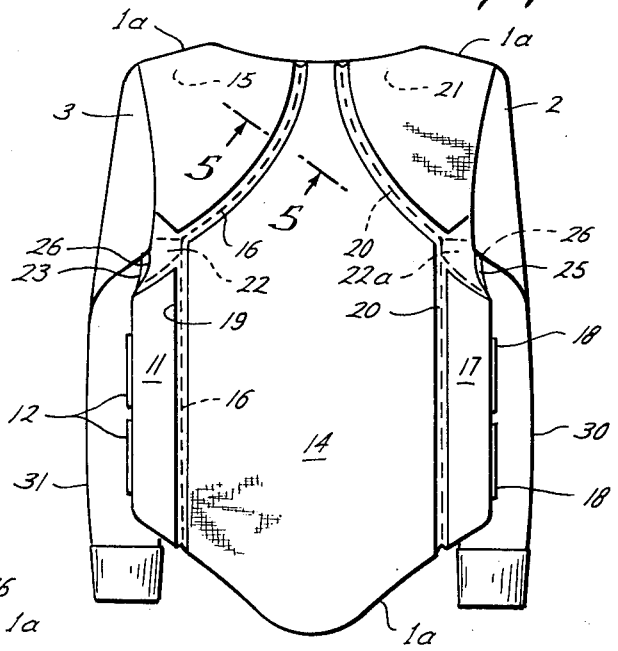
FIG. 2 is a rear vertical view in elevation of the jacket.
Figure 7:
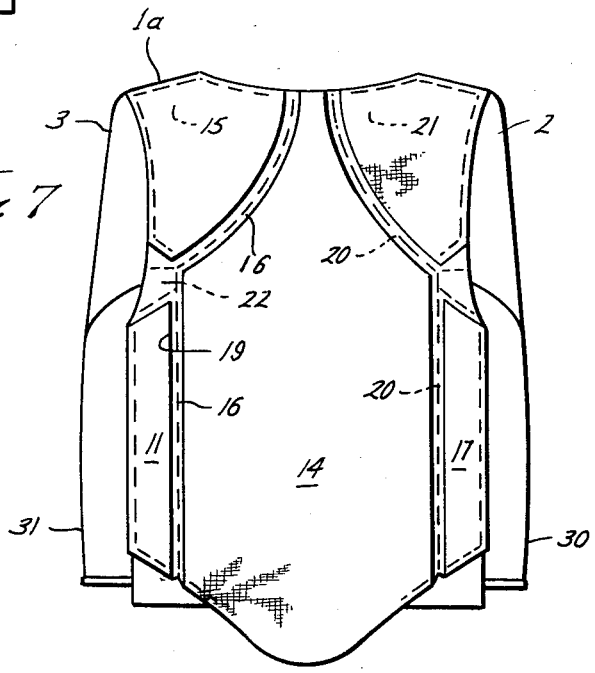
Figure 8:
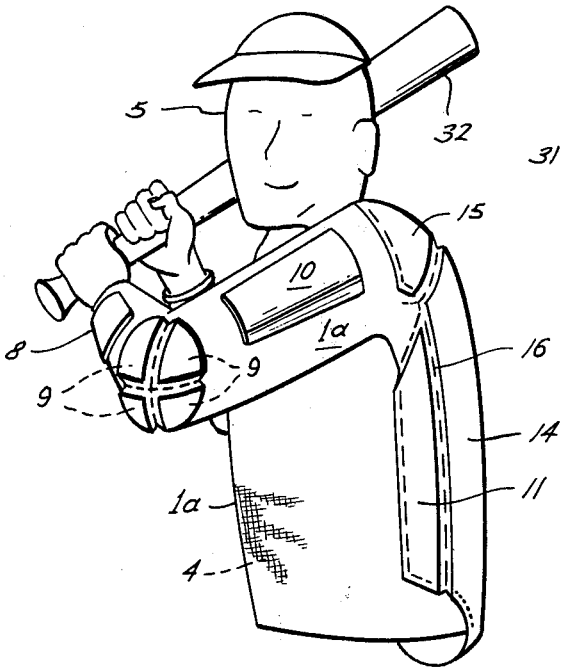

FIG. 7 is a sweater embodiment of the invention and is a rear vertical view in elevation of said pull over inner sweat shirt or sweater showing the padded sections in same positions as that shown on the jacket in FIG. 2; and, FIG. 8 is the sweater embodiment of the invention and is a side vertical view in elevation of the sweater of pull over type fitted on a batter with bat in hand in batting position in batting position of a right handed batter.

The invention will be better understood from a more detailed description thereof reference being had to the accompanying drawings in which like numeraled parts therein in the various views denote like numeraled parts herein.

The numeral 1 denotes the jacket generally and the component parts thereof or affixed thereto comprise left arm 2 and right arm 3. The jacket preferably is of the type which buttons in front center and is fitted on the upper torso 4 of a baseball batter 5, by buttons 6—6 in eyelets 7—7. The left arm of a right handed batter and the right arm of a left handed batter are padded at three most prevalent places where a severe injury may be sustained on the arm facing the pitcher by a thrown baseball by the opposing pitcher.

Detachable plastic padded section 8 on forearm, divided padded sections 9 (four in number), and plastic padded section 10 on side of biceps of the arms are the three protected areas on the arm of the batter facing the pitcher.

The torso 4 of the baseball batter 5 is protected by left vertical padded rib section 11 by elastic strips 12—12 to the rear portions of the front edges 13—13 of the jacket and the jacket material is sewed between said padded rib sections 11 and 17 and back padded section 14 respectively and the material 1*a* is sewed between the top of padded rib sections 11 and 17 and right and left padded shoulder blade sections 15 and 21, as well as, said material 1*a* of jacket 1 is sewed between said padded shoulder blade sections 15 and 21 and the upper portion of padded back section 14, all for the purpose of providing flexibility between all of said padded sections 11, 14, 15, 17 and 21. The back padded section has forward flexible edges 16 and 19 sewed to the vertical rear edges of padded rib sections 11 and 17.

Oppositely disposed right side of torso 4 of the baseball batter 5 is protected by right vertical padded rib section 17 flexibly attached by right side vertical strips 18—18 to vertical rear edges 19 of the vertical right side padded rib section 17 of jacket 1 and also flexibly attached by sewed material 1*a* to vertical edge 20 of material 1*a* of jacket 1 between said right vertical padded rib section 17 and vertical padded back section 14 below right vertical padded shoulder blade section 21 below which is flexible top edge 22*a* of sewed material 1*a* above the vertical right padded rib section 20.

Opening 23 under left arm pit 24 of jacket 1, and, opening 25 under right arm pit 26 of jacket 1 is provided for further flexibility of the jacket 1 fitted on a baseball batter for freedom of movement and for coolness as air passage under arm pits of batter.

The strips 27 (three in number) of a material such as valcuro is sewed to outer surface areas of the forearm and side of bicep area that has an adhesive exterior surface 28, and, underside of hard plastic pads 8 and 10 respectively have a similar valcuro strips (three in number) by which said plastic pads 8 and 10 may be quickly attached and detached to the valcuro strips 28 in order to change said plastic pads 8 and 10 from the left arm of a jacket 1 to the right arm of jacket 1 depending upon whether the batter wearing the jacket 1 is a right handed or left handed batter. The same detachable hard plastic pads 8 and 10 may be used in like manner on left and right handed sleeves 30 and 31 of the sweater embodiment 33 of the invention to protect the forearm or side of bicep of the arm of the batter. It is to be understood that all of the padded sections 8, 10, 11, 14, 15, 17 and 21 of jacket 1 may be interchangeably positioned in same or similar positions on said sweater embodiment 33 as that of jacket embodiment 1, and, some other numbered parts on jacket 1 correspond to the same numbered parts on said pull over type sweater embodiment 33.

Figure 3:
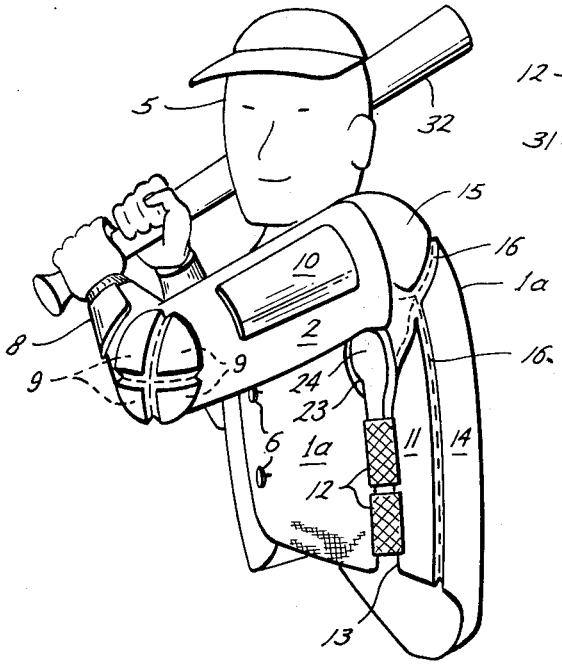
FIG. 3 is a side vertical view in elevation of the jacket fitted on a batter with bat in hand of a right handed batter in batting position.
Figure 4:
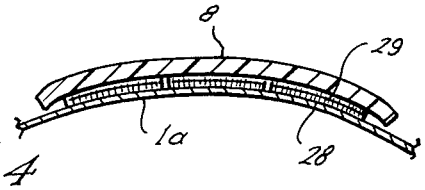
FIG. 4 is a cross-sectional view taken on the line 4—4 of FIG. 1 across the forearm of the jacket cutting through the padded forearm section attached to the exterior of the resilient material to which the padded section is attached.
Figure 5:
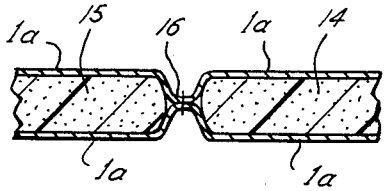
FIG. 5 is a cross-section view taken on the line 5—5 of FIG. 2 showing the flexible sewed portion of the material of the jacket between the left shoulder blade padded section and the back padded section of the jacket.
Figure 6:
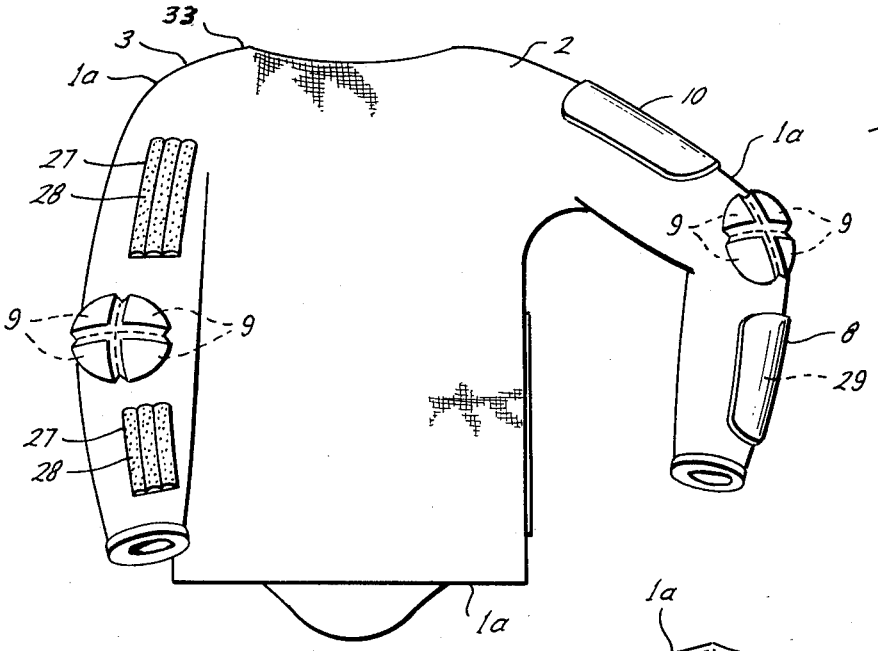
FIG. 6 is the sweater embodiment of the invention and is a front view in elevation of a pull over inner sweat shirt or sweater with the padded section positioned as in FIGS. 1–5 on the jacket.

The baseball batter 5 holds bat 32 both in FIGS. 3 and 8 preparatory to hitting thrown baseball from pitcher of opposing team.

It is obvious that many changes may be made in the details of construction and arrangement of the respective parts of the invention in the various views without departing from the spirit and scope of the invention.

What I claim as new and desire to secure by Letters Patent, is:

1. A protective baseball batting garment having padded flexibly divided sections, said padded divided sections covering the outer elbow portions of said garment to protect the elbows of the batter wearing said garment when hit on the padded elbows divided sections of said garment, small flexible areas between said padded elbow divided sections of said garment to allow the arms of the batter wearing said garment freedom of movement of flexing the elbows in swinging the bat to hit a thrown baseball by the opposing baseball pitcher.

2. A protective baseball batting garment having padded flexibly divided sections and including a left shoulder blade padded flexible divided section for protecting the left shoulder blade of a baseball batter wearing said garment from injury to said left shoulder blade of said batter from a thrown baseball by the opposing baseball pitcher.

3. A protective baseball batting garment having padded flexibly divided sections and including a right shoulder blade padded flexible divided section for protecting the right shoulder blade of a baseball batter wearing said garment from injury to said right shoulder blade of said batter from a thrown baseball by the opposing baseball pitcher.

4. A protective baseball batting garment having padded flexibly divided sections and including shoulder blade padded flexible divided sections for protecting the shoulder blade of a baseball batter wearing said garment, a vertical side rib padded flexibly divided section of said garment for protecting the ribs of a baseball batter from injury to the ribs on the side of batter facing the pitcher by a thrown baseball by the opposing baseball pitcher.

5. A protective baseball batting garment having padded flexibly divided sections, including shoulder blade padded flexible divided sectons for protecting the shoulder blade of a baseball batter wearing said garment facing an opposing baseball pitcher, a vertical side rib padded flexibly divided section of said garment for protecting the ribs of a baseball batter from injury to the ribs on the side of batter facing the pitcher by a thrown baseball by the opposing baseball pitcher, a back padded flexibly divided section of said garment for protecting the back and spine of a baseball batter wearing said garment from injury to the back and spine of a baseball batter by a thrown baseball by the opposing baseball pitcher.

* * * * *